US007275962B1

(12) United States Patent
Yamakami et al.

(10) Patent No.: US 7,275,962 B1
(45) Date of Patent: Oct. 2, 2007

(54) CONNECTOR

(75) Inventors: Tohru Yamakami, Shinagawa (JP); Osamu Daikuhara, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/700,789

(22) Filed: Feb. 1, 2007

(30) Foreign Application Priority Data

Jul. 6, 2006 (JP) ..... 2006-186887

(51) Int. Cl.
*H01R 13/66* (2006.01)

(52) U.S. Cl. ..... 439/620.21

(58) Field of Classification Search ..... 439/620.21, 439/620.22, 76.1, 493
See application file for complete search history.

(56) References Cited

U.S. PATENT DOCUMENTS 5,188,542 A * 2/1993 Ballman ..... 439/620.22
6,565,366 B1 * 5/2003 Wu ..... 439/76.1
2004/0082206 A1 * 4/2004 Chang et al. ..... 439/76.1

FOREIGN PATENT DOCUMENTS

JP 2003-059593 2/2003

* cited by examiner

*Primary Examiner*—Phuong Dinh
(74) *Attorney, Agent, or Firm*—Staas & Halsey LLP

(57) ABSTRACT

A disclosed connector includes a resin package unit assembly made of a combination of a resin package unit and an insulator block inside a shield cover assembly. The resin package unit includes a resin package portion, an element having an equalizer function inside the resin package portion, plural leads for contact protruding from the resin package portion and forming contacts, and plural leads for electrical wire connection protruding from the resin package portion, the plural leads for electrical wire connection being connected to an electrical wire. The insulator block has a groove portion for accepting the leads for contact. The resin package unit and the insulator block are combined with each other while the leads for contact are fitted into the groove portion, and a portion of the leads for contact fitted into the groove portion in the insulator block forms a fit connection unit.

6 Claims, 15 Drawing Sheets

CONNECTOR

BACKGROUND OF THE INVENTION

1. Field of the Invention

The present invention generally relates to a connector and more particularly to a connector disposed on an end of a cable for use when connected to a board side connector mounted on an end of a printed board of an electronic device.

2. Description of the Related Art

In signal transmission between computer devices, a balanced transmission method has been employed in which two signal lines, namely, a first signal line and a second signal line are assigned to a single signal, a positive signal is transmitted via the first signal line, and a negative signal opposite to the positive signal is transmitted via the second signal line so as to perform transmission with high reliability in a trend toward high-speed signal transmission. Various types of connectors supporting this method have been commercialized as products.

A cable side connector has connectors at both ends of a cable. One connector is connected to a board side connector of one computer device and the other connector is connected to a board side connector of the other computer device for use, so that the two computer devices are connected.

FIG. 1 is a schematic diagram showing a conventional cable side connector 10 and a board side connector 40. The cable side connector 10 is disposed on an end of a cable 11 and is connected to the board side connector 40 for use, which is mounted on an end of a printed board 41 of an electronic device.

The cable side connector 10 includes a connector module 12 disposed inside a shield cover assembly 30, in which an end of an electrical wire inside the cable 11 is soldered with the connector module 12.

As shown in FIG. 2, the connector module 12 includes a printed board assembly 20 installed inside a contact assembly 13.

As shown in FIG. 3, the contact assembly 13 includes a pair of signal contacts 15-1 and 15-2 and a platy ground contact 16 pressed into an insulator block 14 from a backside thereof. In the insulator block 14, on a protrusion unit 14*a* protruding forward in a plate-like manner, the signal contacts 15-1 and 15-2 and the ground contact 16 are arranged. This portion constitutes a connector connection portion 18 and the connector connection portion 18 is inserted into the board side connector 40. Terminal portions 15-1*a*, 15-2*a*, and 16*a* are arranged in a protruding manner on the backside of the insulator block 14.

The printed board assembly 20 relays communication between the contact assembly 13 and the cable 11. The printed board assembly 20 includes a printed board 21 on which a capacitor element 25 and a resistance element 26 are mounted. The printed board 21 includes a signal pattern 22 and a ground pattern 23 formed on a top face and a bottom face thereof. Plural lines arranged in parallel constitute the signal pattern 22 and a remaining area constitutes the ground pattern 23. The capacitor element 25 and the resistance element 26 are connected in parallel with each signal pattern 22 and constitute an equalizer circuit unit 27.

In the printed board assembly 20, a front side end of the printed board 21 is fitted into a groove portion 14*b* of the insulator block 14, an end of the signal pattern 22 is soldered with the terminal portions 15-1*a* and 15-2*a*, and an end of the ground pattern 23 is soldered with the terminal portion 16*a*.

The electrical wire at the end of the cable 11 is soldered with an opposite end of the printed board 21.

The above-mentioned equalizer circuit unit 27 has a function of correcting distortion of wave forms of signals transmitted through the cable 11. Presence of the equalizer circuit unit 27 improves reliability of signal transmission. In addition, it is possible to increase a length of the cable 11 to about two times a conventional length of about 5 m, namely, 10 m.

Patent Document 1: Japanese Laid-Open Patent Application No. 2003-059593

However, the above-mentioned cable side connector 10 requires the printed board assembly 20 and the signal contacts 15-1 and 15-2 as independent parts, so that the number of parts is large.

SUMMARY OF THE INVENTION

It is a general object of the present invention to provide an improved and useful connector in which the above-mentioned problem is eliminated.

A more specific object of the present invention is to provide a connector that can be manufactured in an inexpensive manner.

According to the present invention, there is provided a connector including: a shield cover assembly having an equalizer function unit therein; a fit connection unit having contacts arranged at a tip of the shield cover assembly, the fit connection unit being fitted and connected to a destination connector; a cable extending from a backside of the shield cover assembly; and a resin package unit assembly inside the shield cover assembly, the resin package unit assembly being made of a combination of a resin package unit and an insulator block, wherein the resin package unit includes a resin package portion, an element having an equalizer function inside the resin package portion, a plurality of leads for contact protruding from the resin package portion and forming contacts, and a plurality of leads for electrical wire connection protruding from the resin package portion, the plural leads for electrical wire connection being connected to an electrical wire, the insulator block has a groove portion for accepting the leads for contact, the resin package unit and the insulator block are combined with each other while the leads for contact are fitted into the groove portion, and a portion of the leads for contact fitted into the groove portion in the insulator block forms the fit connection unit, and an electrical wire extending from an end of the cable is connected to the lead for electrical wire connection.

According to the present invention, the necessity of contact members and a printed board for relaying communication is eliminated and the resin package unit is manufactured using a method for manufacturing a semiconductor device. Thus, it is possible to manufacture a connector in an inexpensive manner in comparison with a conventional connector.

Other objects, features and advantage of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

Figure 4:
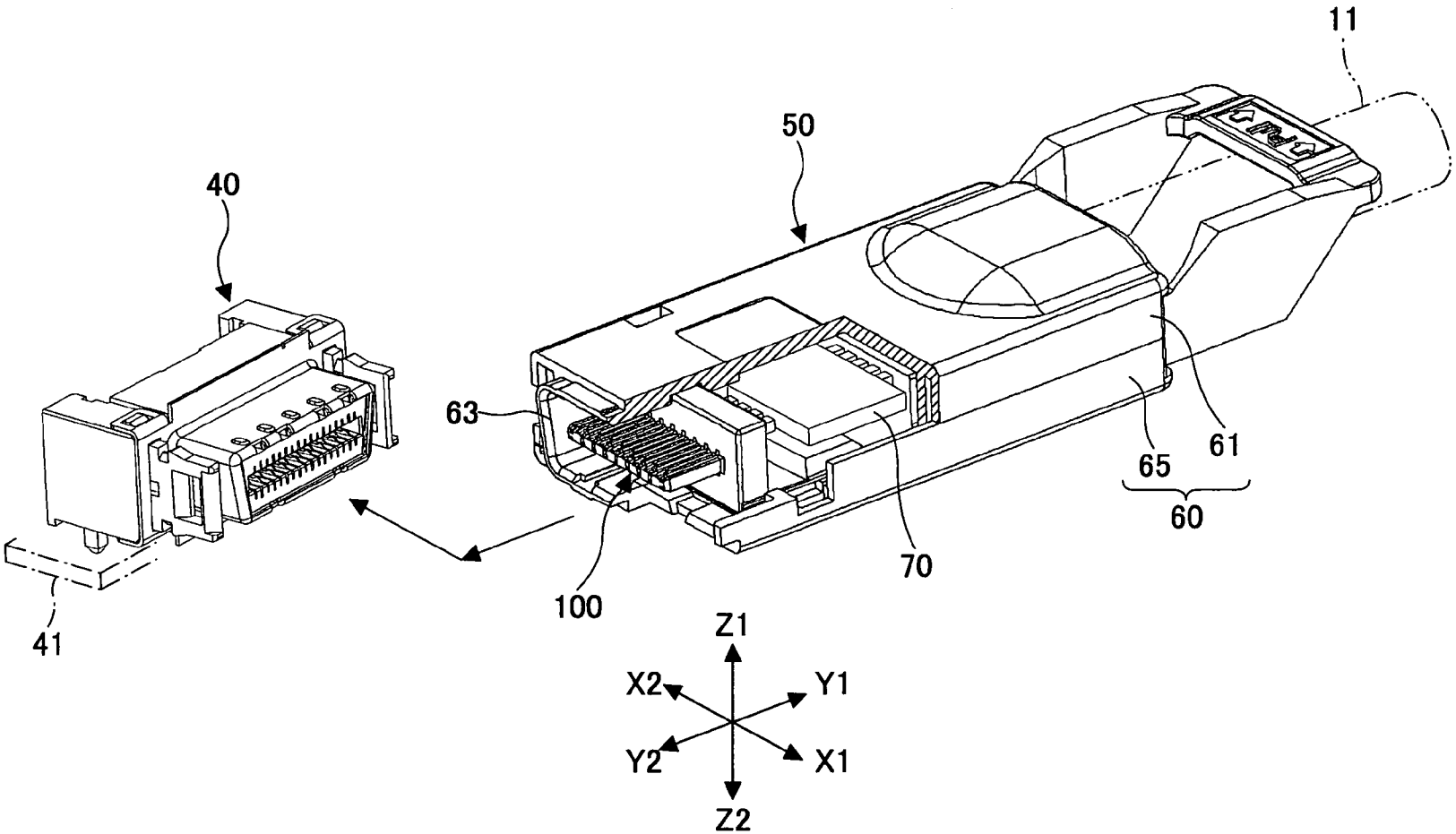
FIG. 4 is a perspective view showing a cable side connector and a board side connector according to example 1 of the present invention.
Figure 5:
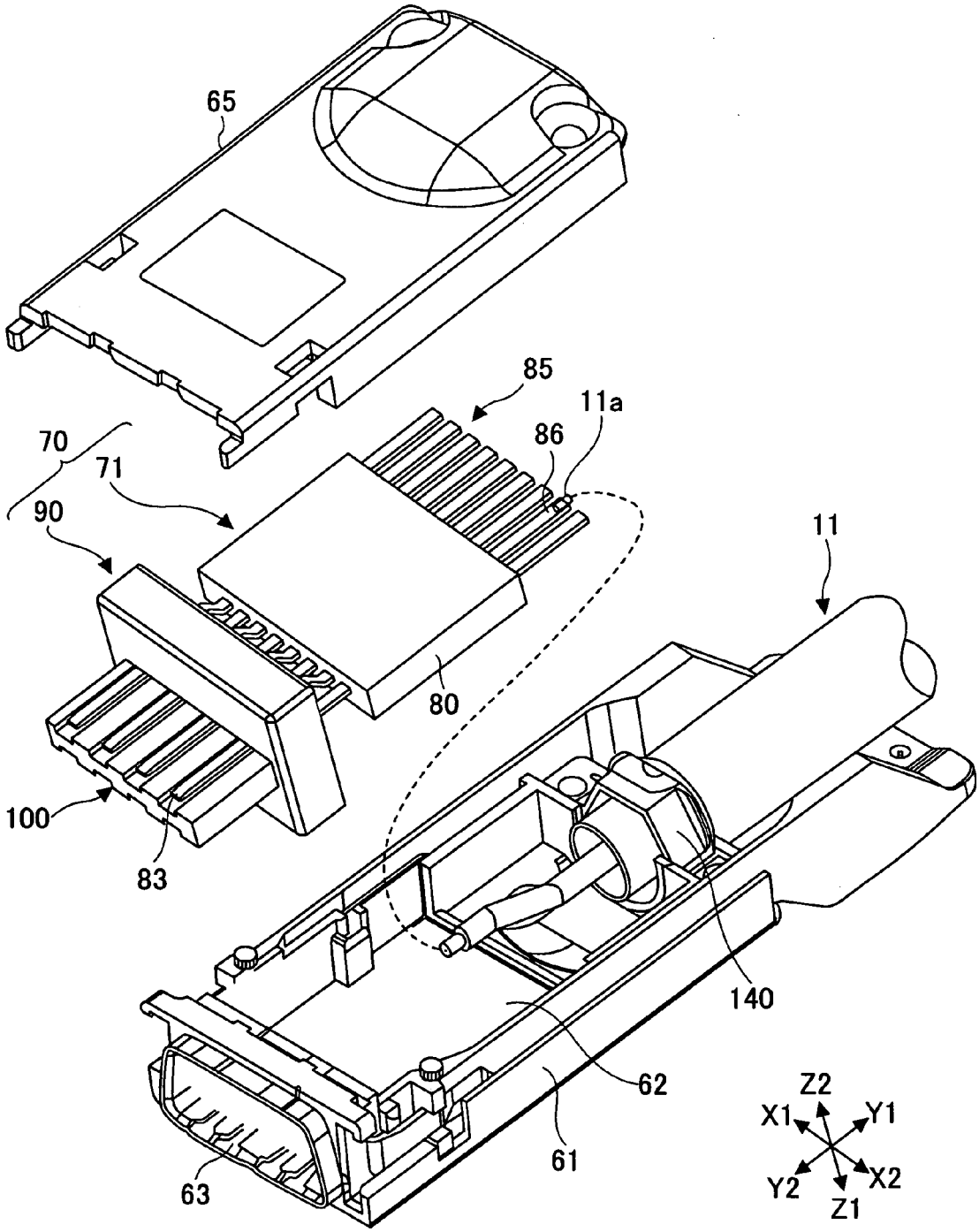
FIG. 5 is an exploded perspective view showing the cable side connector in FIG. 4.

FIG. 4 is a perspective view showing a cable side connector 50 and a board side connector 40 according to example 1 of the present invention. The cable side connector 50 and the board side connector 40 are capable of performing balanced transmission. FIG. 5 is an exploded perspective view showing the cable side connector 50 in FIG. 4 in an inverted manner. FIGS. 6A to 7C show the cable side connector 50 based on the inverted position in FIG. 5.

The cable side connector 50 is connected to an end of the cable 11 extending from Y1 direction. The cable side connector 50 is connected to board side connector 40 to be used, the board side connector 40 being mounted on an end of the printed board 41 of an electronic device. In the cable 11, plural paired wires and drain wires are incorporated.

Reference numerals X1-X2, Y1-Y2, and Z1-Z2 designate a width direction, a longitudinal direction, and a height direction of the cable side connector 50, respectively. Reference numeral Y1 designates a backward direction and reference numeral Y2 designates a forward direction (insert direction upon connection).

As shown in FIGS. 4 and 5, the cable side connector 50 has a resin package unit assembly 70 embedded in a shield cover assembly 60. At a tip of the shield cover assembly 60 (Y2 direction), a fit connection unit 100 is disposed in a center of an opening frame 63 in a protruding manner.

[Structure of the Shield Cover Assembly 60]

The shield cover assembly 60 includes a cover body 61 having a substantially box-like shape and a cover member 65 having a substantially plate-like shape, both being formed as aluminum or zinc die-cast members. The cover member 65 is fixed on the cover body 61 using a screw in the Z2 direction and the cover member 65 covers an opening 62 of the cover body 61 in the Z2 direction. The cover body 61 has the opening frame 63 having a substantially quadrangle-like shape in the Y2 direction.

[Structure of the Resin Package Unit Assembly 70]

Figure 6A:
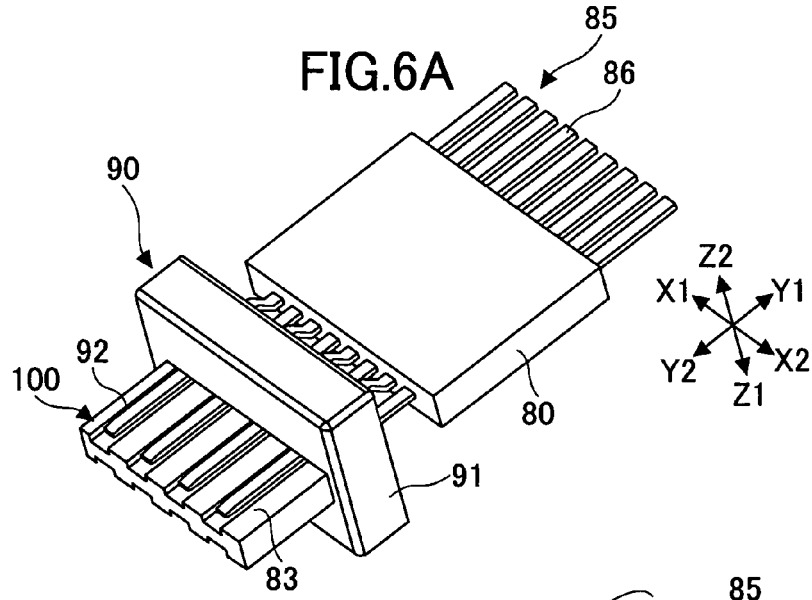
FIG. 6A is a perspective view showing a resin package unit assembly.
Figure 6D:
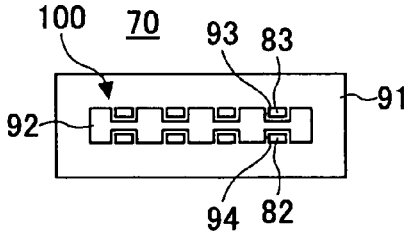
FIG. 6D is a diagram showing a resin package unit assembly when viewed from a Y2 direction.

FIG. 6A is a diagram showing the resin package unit assembly 70. FIG. 6D is a diagram showing the resin package unit assembly 70 in FIG. 6A when viewed from the Y2 direction, particularly showing the fit connection unit 100. The resin package unit assembly 70 includes a resin package unit 71 and an insulator block 90 shown in FIG. 6B in a combined manner.

As shown in FIGS. 6B and 7A to 7C, in the resin package unit 71, a resin package element 72 having an equalizer function is sealed with resin inside a flat resin package portion 80 having a rectangular parallelepiped shape. In addition, a lead group 81 for contact forming a contact of the cable side connector 50 protrudes from the resin package portion 80 in the Y2 direction and a lead group 85 for electrical wire connection to which an electrical wire is connected protrudes from the resin package portion 80 in the Y1 direction.

The resin package element 72 has a gull-wing structure, in which an active-type phyIC chip 73 having an equalizer function is sealed with resin inside a resin package 74 and leads 75 and 76 for mounting protrude from the resin package 74. The resin package element 72 is what is called a retimer device. Although the active-type phyIC chip 73 requires electric power supply, the phyIC chip 73 functions so as to raise a signal level in addition to correction of distortion of a transmitted signal.

The lead group 81 for contact includes plural pairs of leads 82 and 83 for contact. Each of the leads 82 and 83 for contact has lead portions 82*a* and 83*a* collected toward a center of the resin package portion 80 in the Y1 direction. The lead portions 82*a* and 83*a* are arranged in a substantially radial manner. The lead 83 for contact has a bending portion 83*b* at a position close to the resin package portion 80 and is positioned in the Z2 direction relative to the lead 82 for contact (refer to FIGS. 7B and 7C). The lead 82 for contact and the lead 83 for contact form a pair. And, the leads 82 and 83 for contact forming a pair protrude from the resin package portion 80 in the Y2 direction and the pairs are arranged in the X1-X2 direction.

The lead group 85 for electrical wire connection includes plural leads 86 for electrical wire connection. Each of the leads 86 for electrical wire connection has a lead portion 86*a* collected toward the center of the resin package portion 80 in the Y2 direction. The lead portions 86*a* are arranged in a substantially radial manner. The leads 86 for electrical wire connection protrude from the resin package portion 80 in the Y1 direction and the pairs are arranged in the X1-X2 direction.

In the resin package element 72, the leads 75 and 76 are supported by ends of the lead portions 82*a* and 83*a* and the lead portions 86*a* and soldered, such that the resin package element 72 is mounted.

In the resin package portion 80, the lead portions 82*a* and 83*a* and the lead portion 86*a* are sealed in addition to the resin package element 72.

Figure 6B:
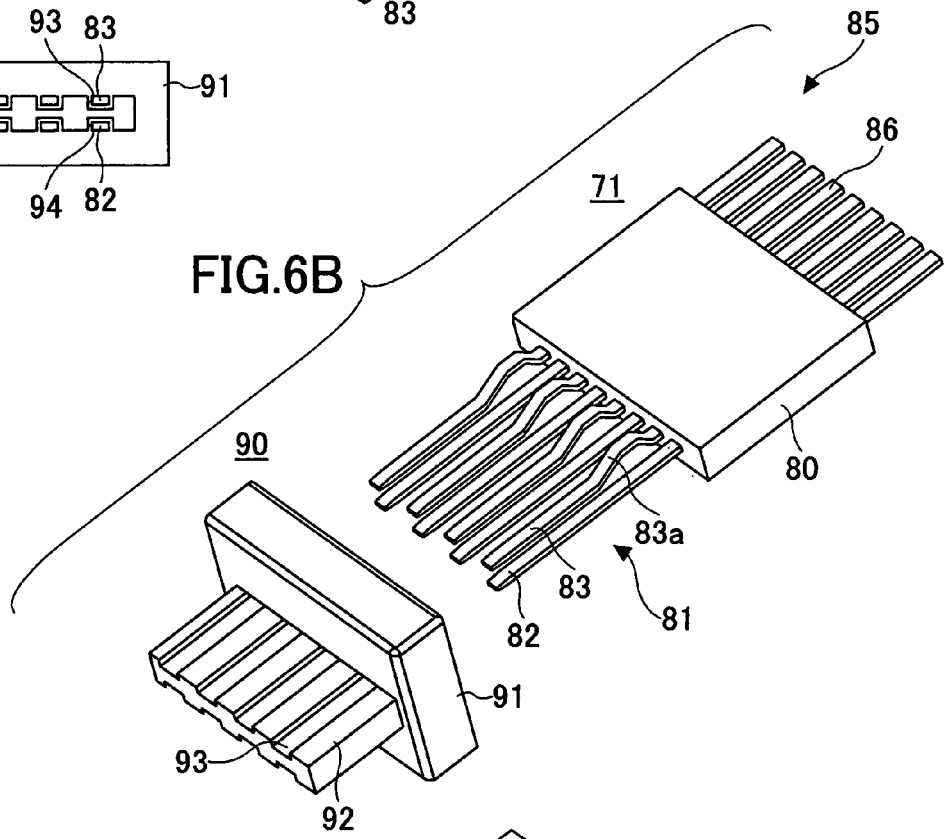
FIG. 6B is a perspective view showing an insulator block and a resin package unit constituting the resin package unit assembly in FIG. 6A.
Figure 6C:
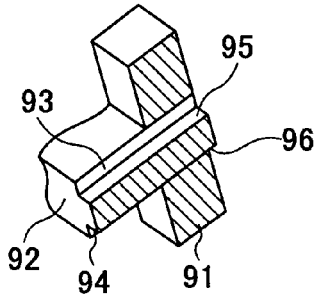
FIG. 6C is a perspective cross-sectional view showing an insulator block.
Figure 7A:
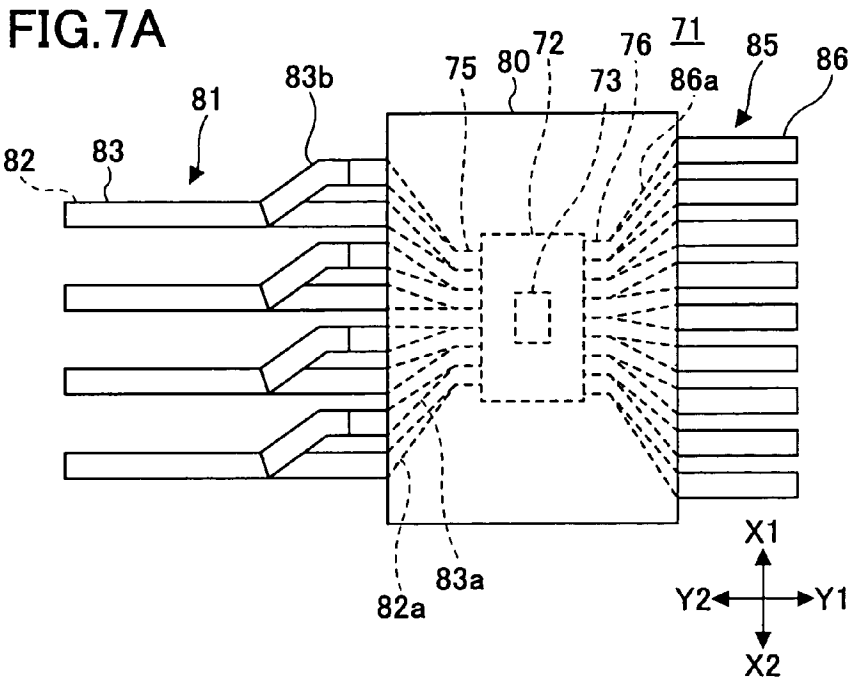
FIG. 7A is a plan view showing a resin package unit.
Figure 7B:
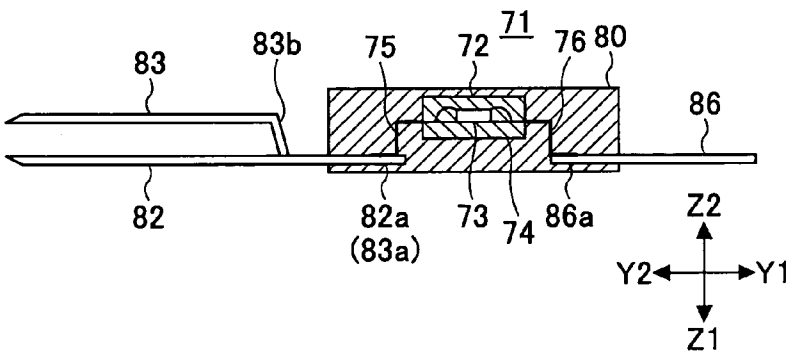
FIG. 7B is a cross-sectional view showing a resin package unit.
Figure 7C:
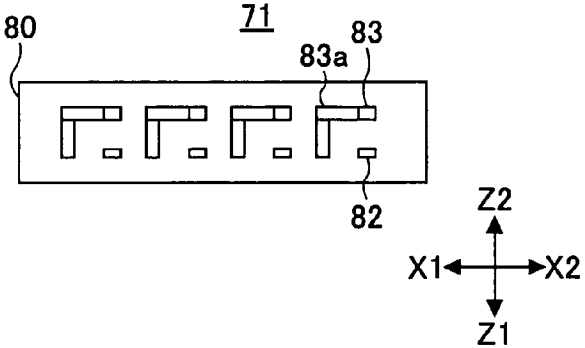
FIG. 7C is a left side elevational view showing a resin package unit.

As shown in FIG. 6B, the insulator block 90 is a molded member made of synthetic resin and includes a flange unit 91 and a plate-like protrusion unit 92 protruding from the flange unit 91 in the Y2 direction. As shown in FIG. 6C, on top and bottom faces of the protrusion unit 92, there are disposed groove portions 93 and 94 into which the leads 82 and 83 for contact are fitted. In the flange unit 91, a through hole 95 extending from the groove portion 93 and a through hole 96 extending from the groove portion 94 are formed.

The lead 82 for contact penetrates through the through hole 96 and is fitted into the groove portion 94 and the lead 83 for contact penetrates through the through hole 95 and is fitted into the groove portion 93 from the Y1 direction of the insulator block 90, so that the resin package unit 71 and the insulator block 90 are combined.

As mentioned above, by combining the resin package unit 71 with the insulator block 90, the fit connection unit 100 is formed and the resin package unit assembly 70 is provided. As shown in FIG. 6D, in the fit connection unit 100, the lead 82 for contact is fitted into the groove portion 94 of the plate-like protrusion unit 92, extending in the Y2 direction, and is exposed on a Z1 face and another lead 83 for contact is fitted into the groove portion 93 of the plate-like protrusion unit 92, extending in the Y2 direction, and is exposed on a Z2 face. In this manner, plural leads 82 and 83 for contact are arranged in the X1-X2 direction at a predetermined pitch.

[Steps of Manufacturing the Resin Package Unit 71]

In the following, steps of manufacturing the resin package unit 71 is described in a simplified manner with reference to FIGS. 8A to 11B for comprehension of a structure of the above-mentioned resin package unit 71.

Figure 8A:
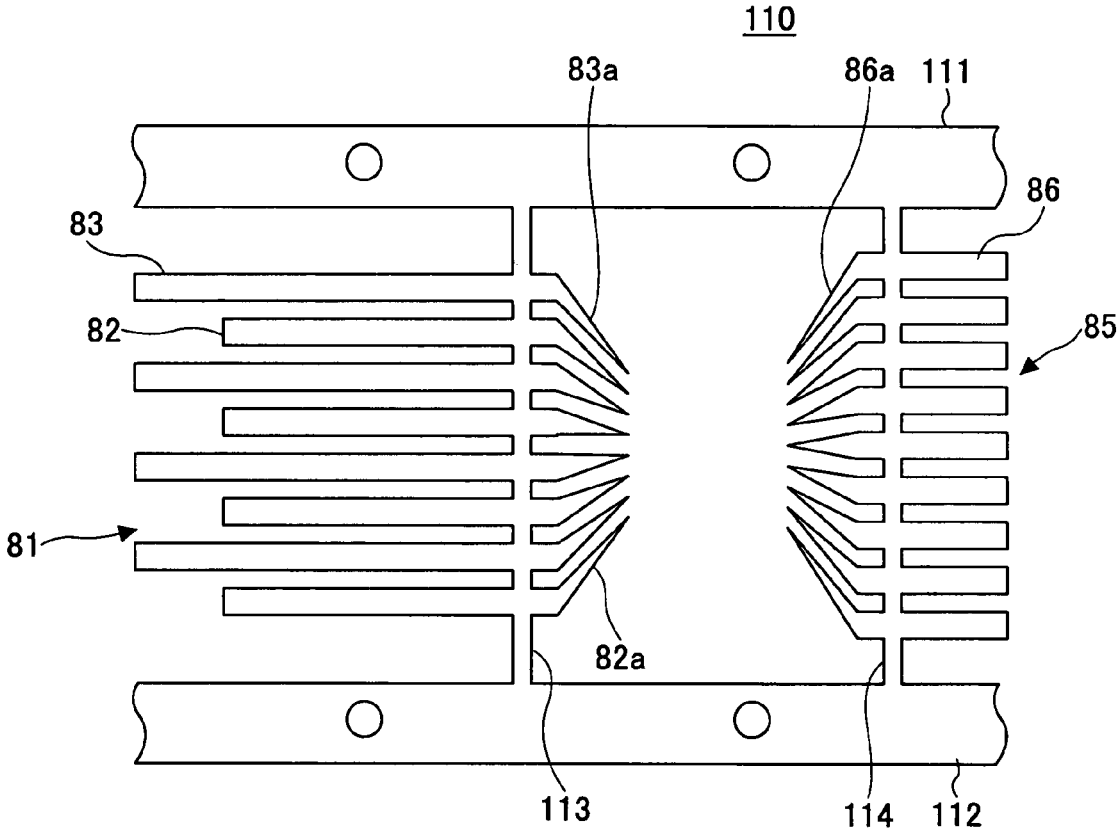
FIG. 8A is a plan view showing a lead frame used for manufacturing the resin package unit in FIG. 7A.
Figure 8B:
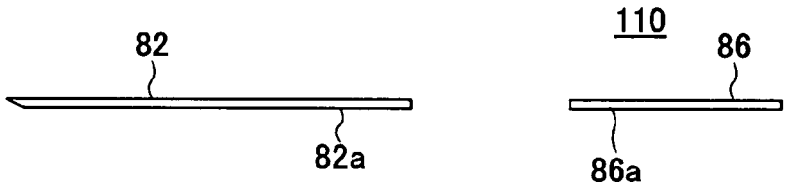
FIG. 8B is a cross-sectional view showing a lead frame used for manufacturing the resin package unit in FIG. 7A.

A lead frame 110 shown in FIGS. 8A and 8B is prepared. Numerals 111 and 112 designate band portions on both sides. Numeral 113 designates a tie bar connecting the leads 82 and 83 for contact to the band portions 111 and 112. Numeral 114 designates another tie bar connecting the leads 86 for electrical wire connection to the band portions 111 and 112.

Figure 9:
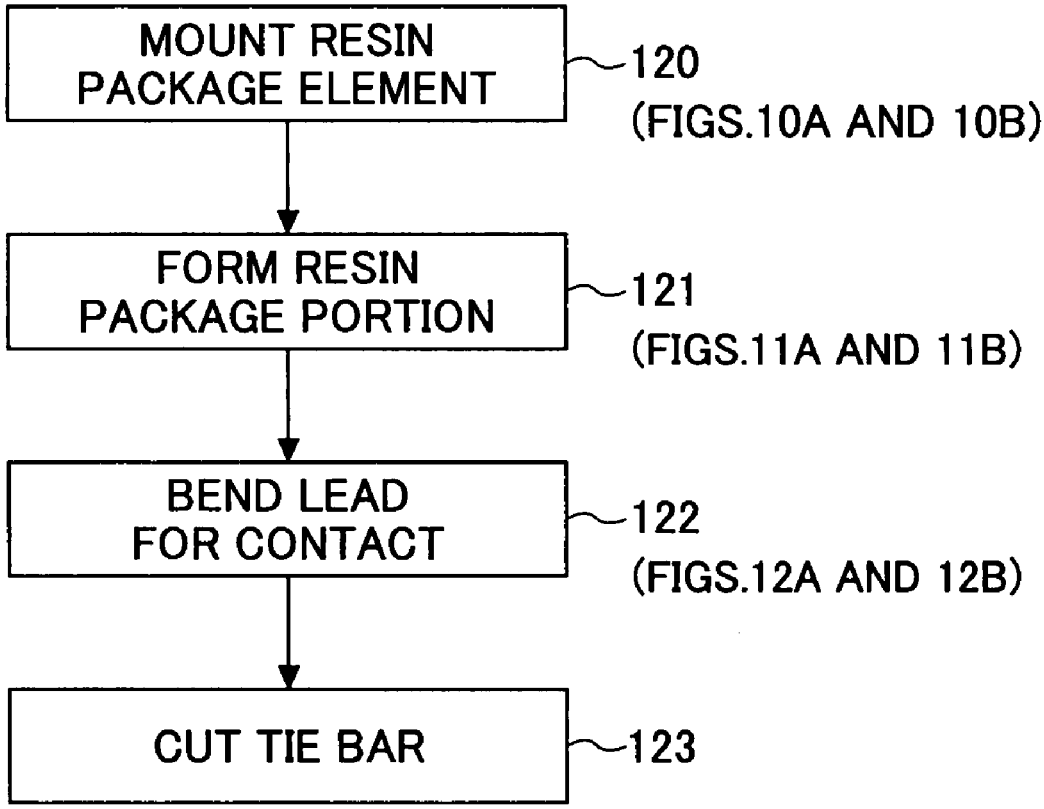
FIG. 9 is a flow chart showing steps of manufacturing the resin package unit in FIG. 7A.

FIG. 9 is a flow chart showing steps of manufacturing the resin package unit 71.

[Steps 120 of Mounting the Resin Package Element]

Figure 10A:
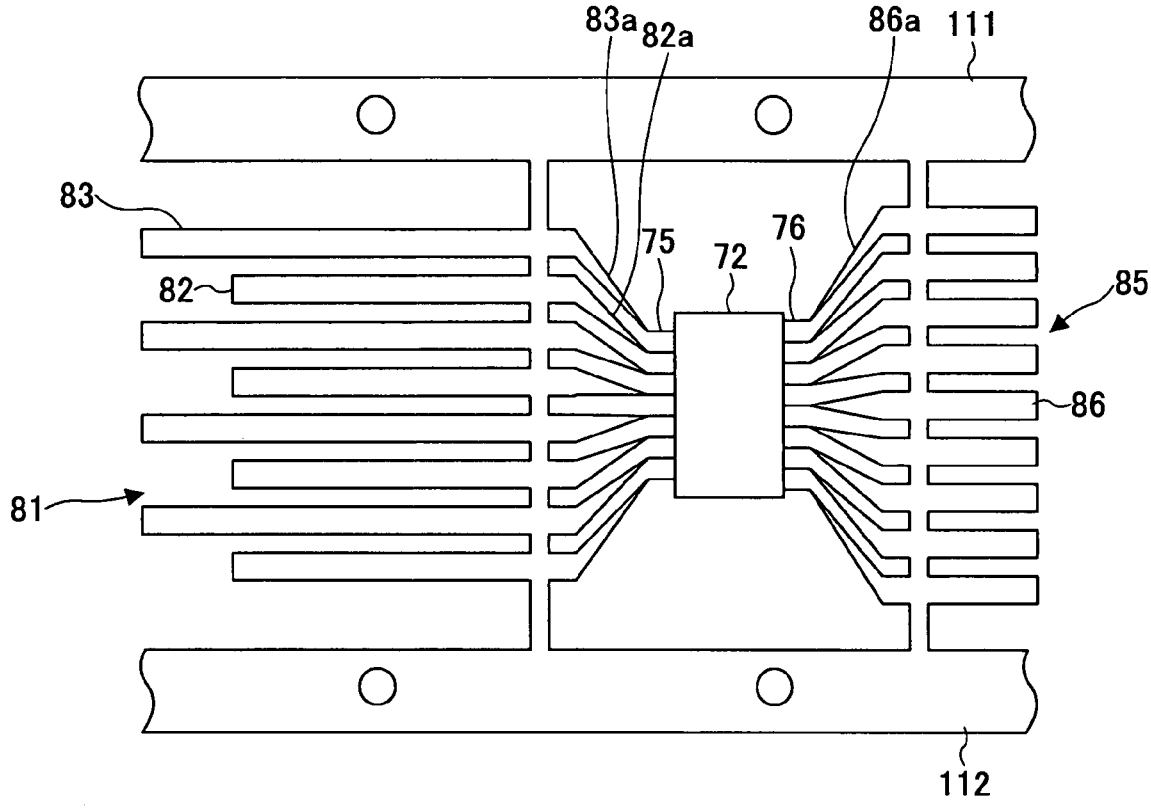
FIG. 10A is a plan view showing a status when a step of mounting a resin package element is completed.
Figure 10B:
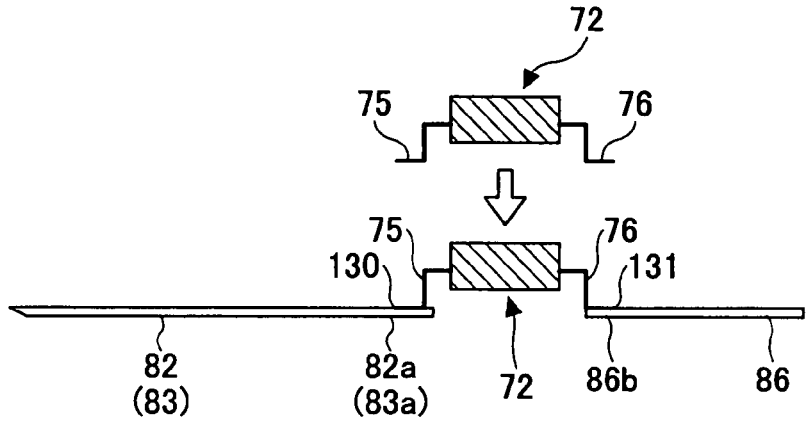
FIG. 10B is a cross-sectional view showing a status when a step of mounting a resin package element is completed.

First, as shown in FIGS. 10A and 10B, the resin package element 72 is placed by positioning the leads 75 and 76 so as to be supported by ends of the lead portions 82*a* and 83*a* and the lead portion 86*a*. Then, the leads 75 and 76 positioned on the ends of the lead portions 82*a* and 83*a* and the lead portions 86*a* are soldered and mounted through a reflow process. Numerals 130 and 131 designate soldering portions.

[Steps 121 of Forming the Resin Package Portion]

Figure 11A:
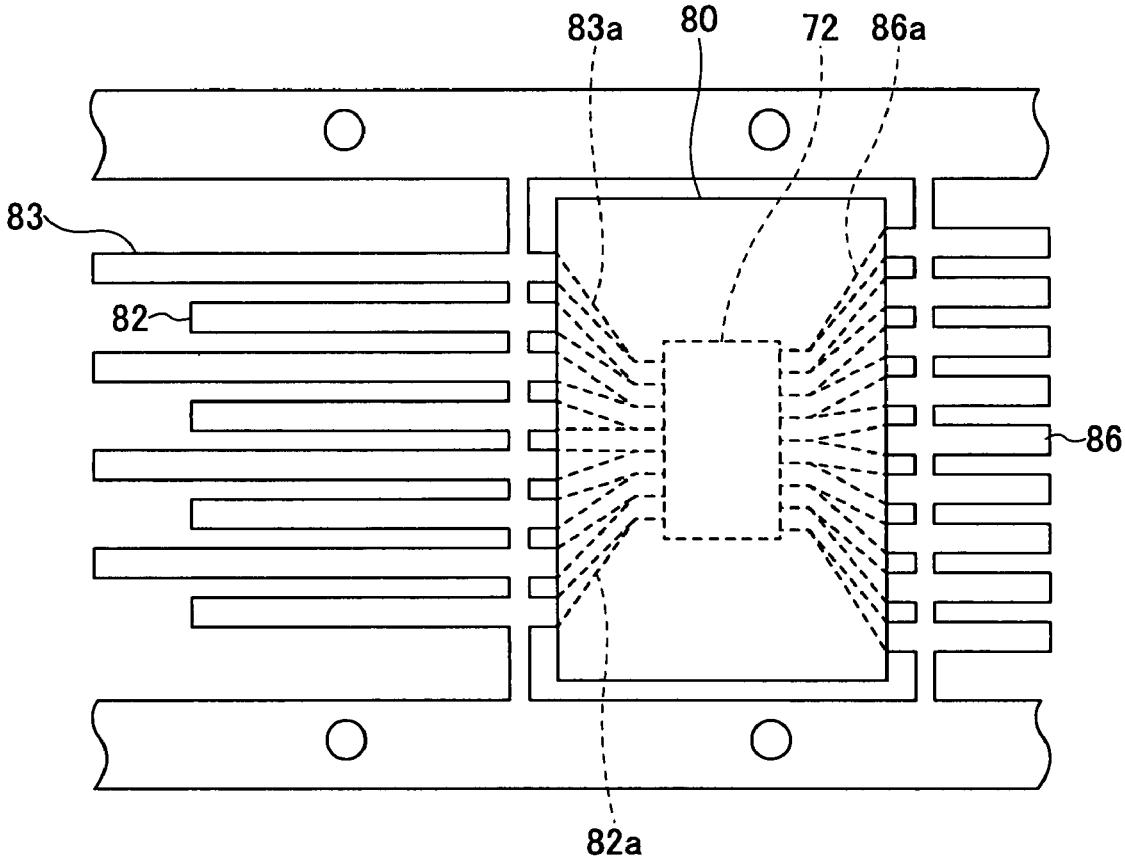
FIG. 11A is a plan view showing a status when a step of forming a resin package portion is completed.
Figure 11B:
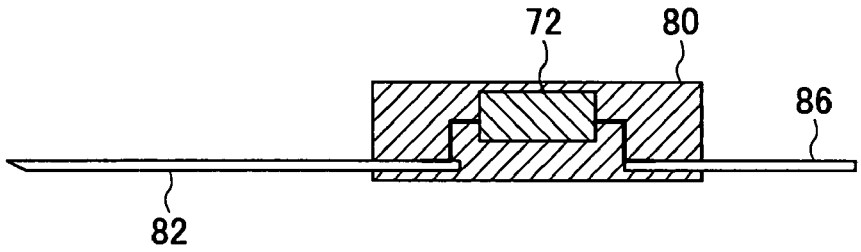
FIG. 11B is a cross-sectional view showing a status when a step of forming a resin package portion is completed.

Next, as shown in FIGS. 11A and 11B, the resin package portion 80 is formed. The resin package portion 80 is formed to ends of the tie bars 113 and 114, so that the resin package element 72, the lead portions 82*a*, 83*a*, and 86*a* are sealed.

[Steps 122 of Bending the Lead for Contact]

Figure 12A:
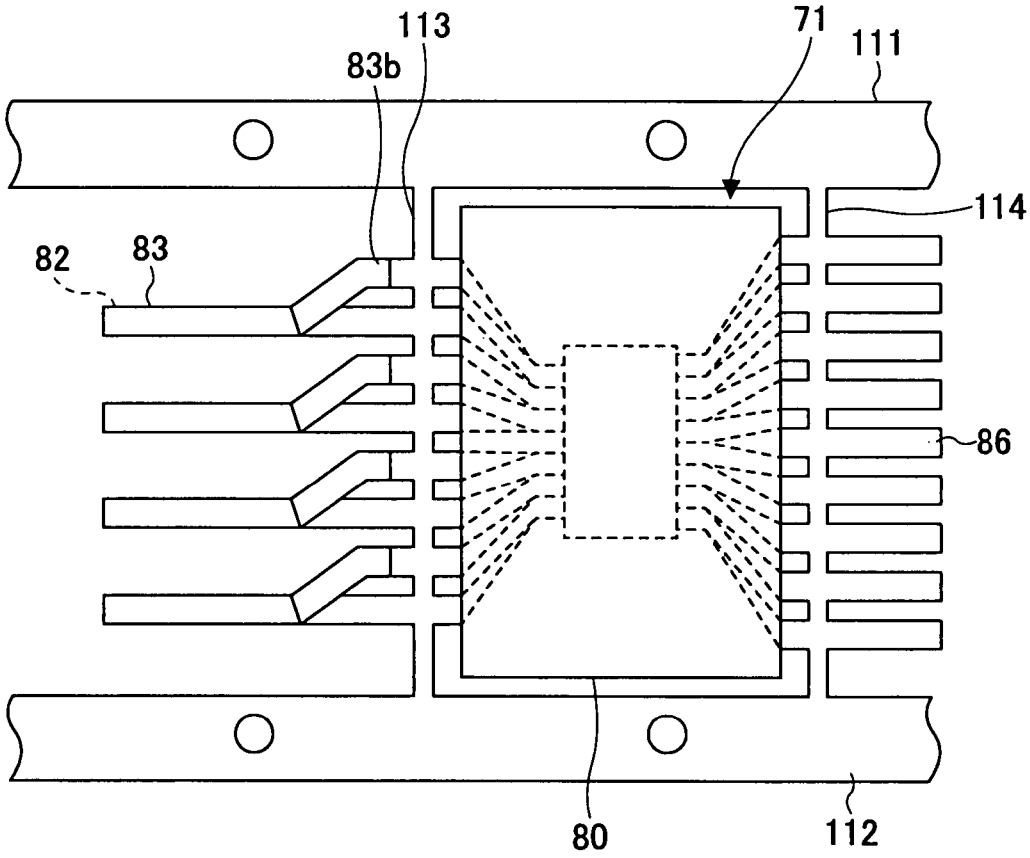
FIG. 12A is a plan view showing a status when a step of bending a lead for contact is completed.
Figure 12B:
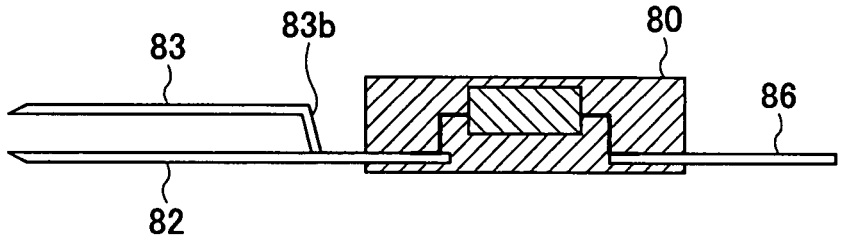
FIG. 12B is a cross-sectional view showing a status when a step of bending a lead for contact is completed.

Next, as shown in FIGS. 12A and 12B, a portion of the lead 83 for contact is bent so as to form the bending portion 83*b* such that the lead 83 for contact is positioned in the Z2 direction relative to the lead 82 for contact. In this status, the resin package unit 71 shown in FIG. 7 is substantially manufactured in which the leads 82 and 83 for contact are linked, the leads 86 for electrical wire connection are linked, and the band portions 111 and 112 are linked using the tie bars 113 and 114.

[Steps 123 of Cutting the Tie Bars]

Finally, the tie bars 113 and 114 are cut at plural locations and removed, so that the resin package unit 71 is completed after being separated from the fit connection unit 100.

[Assembly, Usage, and the Like of the Cable Side Connector 50]

As shown in FIGS. 4 and 5, the resin package unit assembly 70 is embedded in the cover body 61 from the opening 62 while an electrical wire 11*a* extending from the end of the cable 11 is soldered and connected to the lead 86 for electrical wire connection. The fit connection unit 100 is positioned in the center of the opening frame 63 and protrudes in the Y2 direction inside the opening frame 63. The flange unit 91 is brought into abutment with the opening frame 63 in the Y1 direction. The resin package portion 80 is positioned and stored in the cover body 61. The cover member 65 presses the resin package portion 80.

The end of the cable 11 is caulked by a caulking member 140. The attached cover member 65 clamps the caulked portion of the cable 11 between the cover body 61 and the cover member 65. In accordance with this, the manufacturing of the cable side connector 50 is completed.

In addition, a single electrical wire for power supply (not shown in the drawings) extending from the end of the cable 11 is connected to a predetermined lead 86 for electrical wire connection.

As shown in FIG. 4, in the cable side connector 50, the fit connection unit 100 is inserted into a fit hole portion of the board side connector 40 of one computer device and connected. The other cable side connector at the opposite end of the cable 11 is connected to a board side connector of other computer device. In this manner, connection between the two computer devices is established. Positive signals are transmitted through the leads 82 for contact and negative signals are transmitted through the leads 83 for contact.

The phyIC chip 73 is driven by an external voltage, the distortion of wave forms of signals transmitted through the cable 11 is corrected, and the reliability of signal transmission is improved. In addition, it is possible to increase the length of the cable 11 to a maximum of not less than two times the conventional length of about 5 m.

Figure 1:
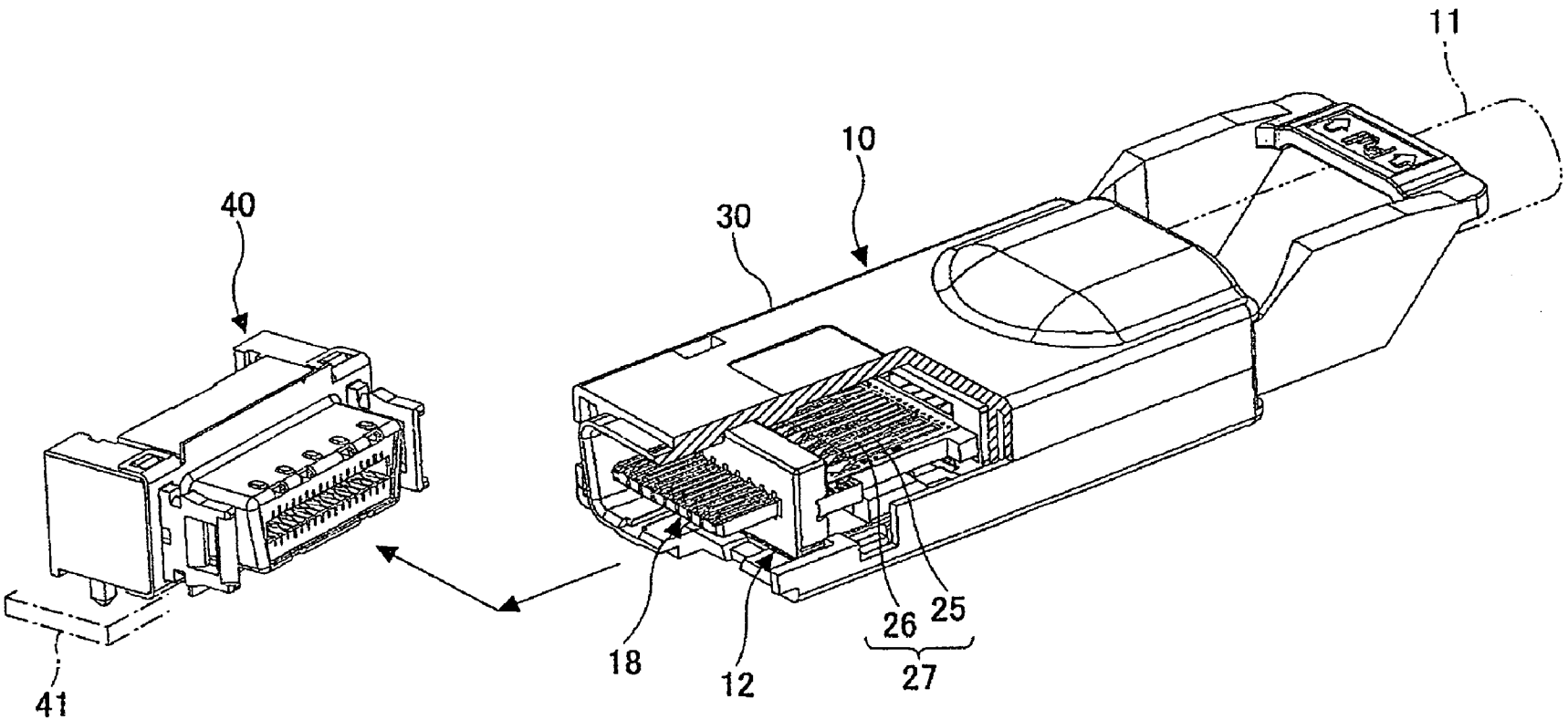
PRIOR ART FIG.1
FIG. 1 is a perspective view showing a conventional cable side connector and board side connector.
Figure 2:
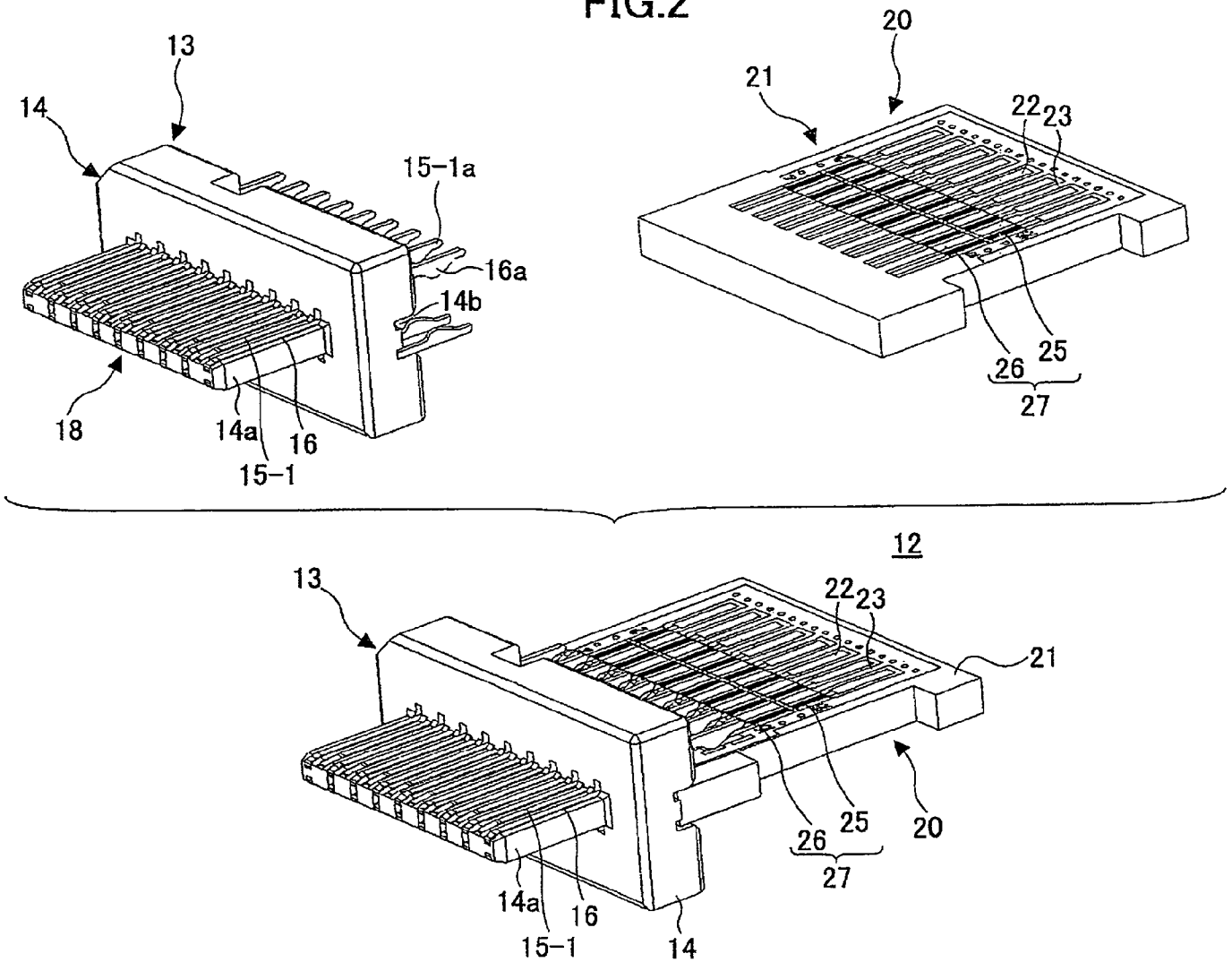
PRIOR ART FIG.2
FIG. 2 is a perspective view showing a connector module constituting the cable side connector in FIG. 1.
Figure 3:
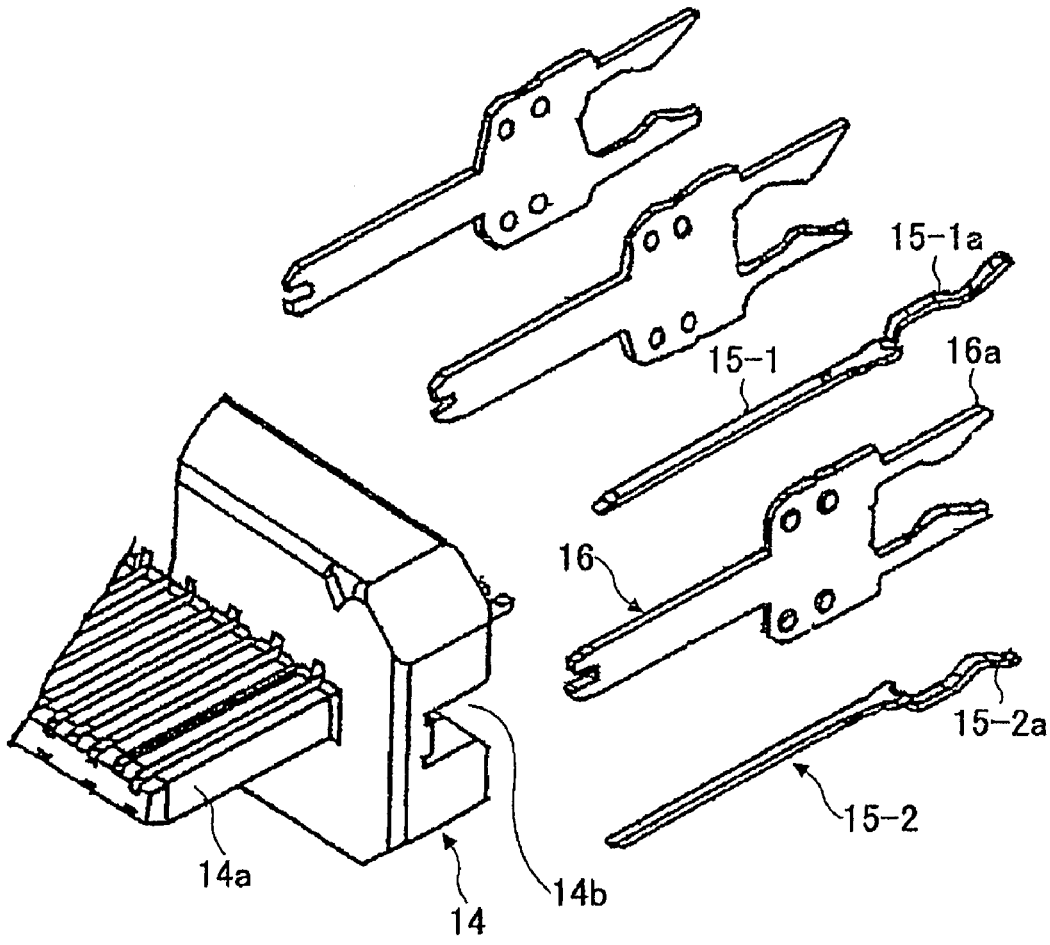
PRIOR ART FIG.3
FIG. 3 is an exploded view showing a contact assembly constituting the connector module in FIG. 2.

As understood from FIGS. 4 and 5, the cable side connector 50 does not require the printed board assembly or the signal contact, which have conventionally been necessary in comparison with the cable side connector 10 shown in FIGS. 1 to 3. Thus, the number of parts is reduced, so that a manufacturing cost of the cable side connector 50 is inexpensive in comparison with that of the cable side connector 10.

Instead of the phyIC chip 73, a passive-type IC chip may be used.

[Structure of Another Resin Package Unit 71A]

Figure 13A:
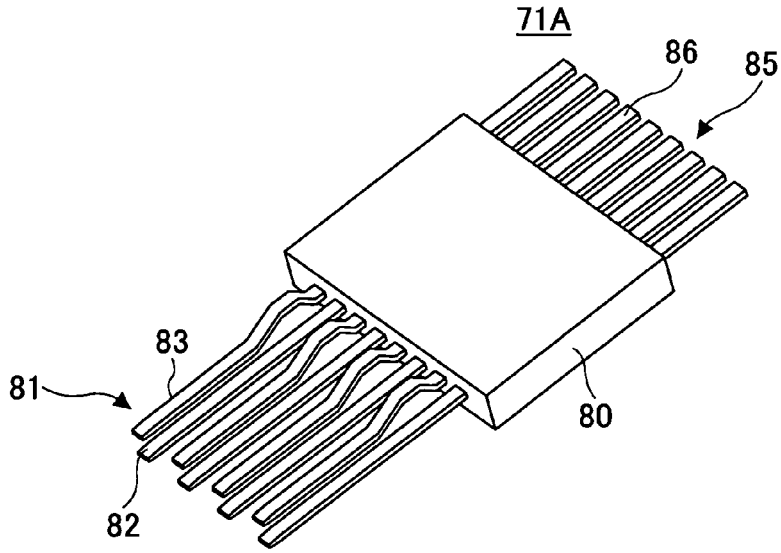
FIG. 13A is a perspective view showing a resin package unit according to another example.
Figure 13B:
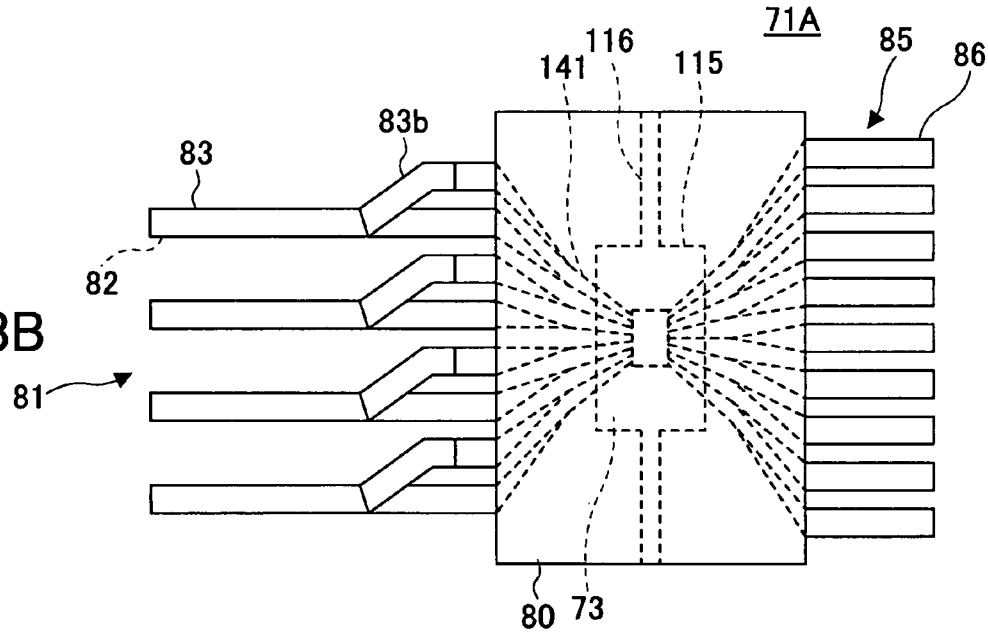
FIG. 13B is a plan view showing a resin package unit according to another example.
Figure 13C:
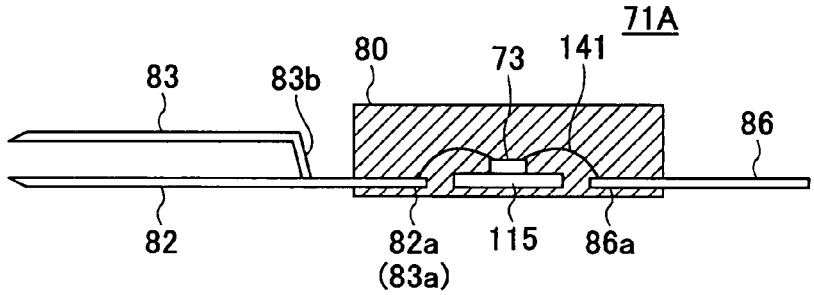
FIG. 13C is a cross-sectional view showing a resin package unit according to another example.

Next, another resin package unit 71A is described, FIGS. 13A to 13C are diagrams showing the resin package unit 71A. The resin package unit 71A is different in structure from the above-mentioned resin package unit 71 shown in FIGS. 7A to 7C in that the phyIC chip 73 is mounted instead of the resin package element 72 and the phyIC chip 73 is sealed using the resin package portion 80.

Figure 14A:
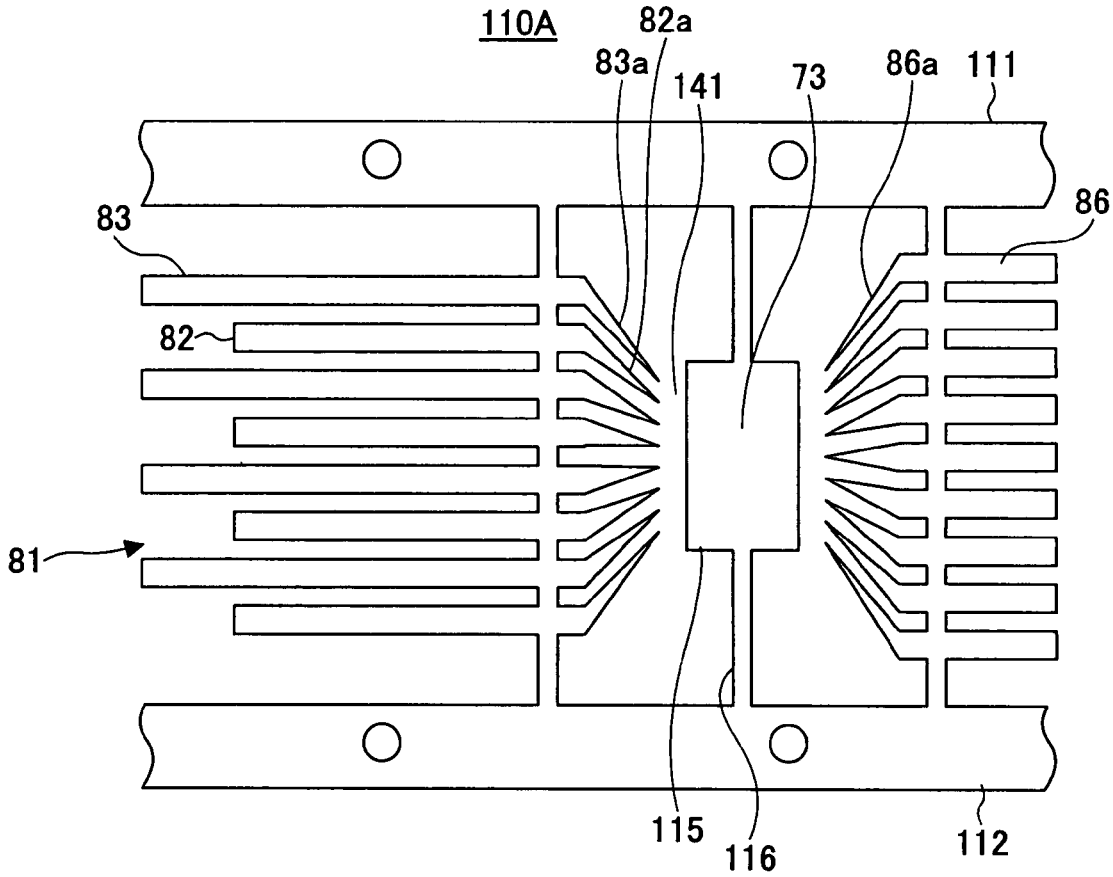
FIG. 14A is a plan view showing a lead frame used for manufacturing the resin package unit in FIG. 13A.
Figure 14B:
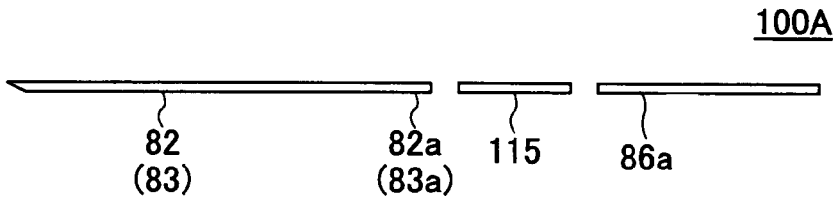
FIG. 14B is a cross-sectional view showing a lead frame used for manufacturing the resin package unit in FIG. 13A.
Figure 15A:
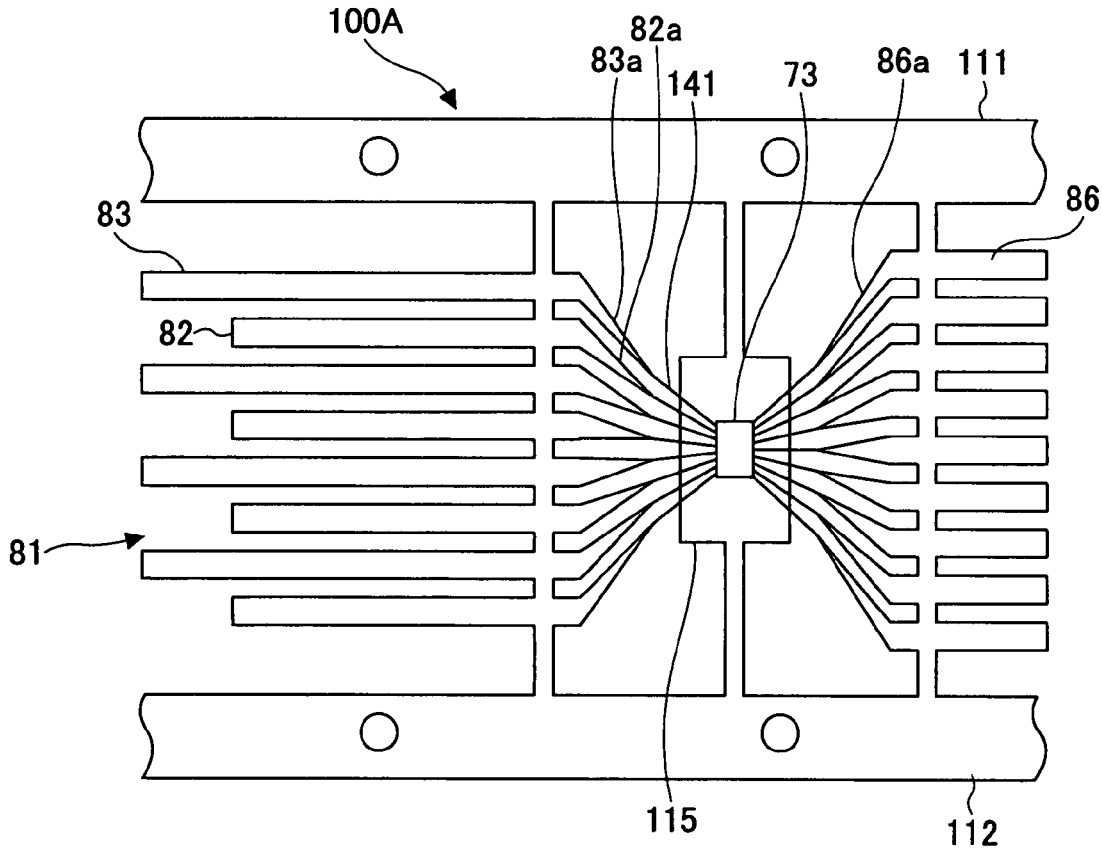
FIG. 15A is a plan view showing a status when a chip is mounted and wire bonding is completed.
Figure 15B:
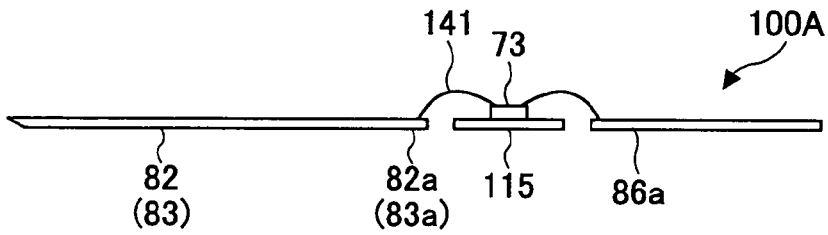
FIG. 15B is a cross-sectional view showing a status when a chip is mounted and wire bonding is completed.

A lead frame 110A shown in FIGS. 14A and 14B is used. The lead frame 110A is different from the lead frame 110 shown in FIGS. 8A and 8B in that an island 115 and a tie bar 116 are additionally disposed. As shown in FIGS. 15A and 15B, the phyIC chip 73 is mounted on the island 115 and wire bonding is carried out, so that wires 141 are disposed between a pad of a top face of the phyIC chip 73 and the lead portions 82*a*, 83*a*, and 86*a*. In the resin package portion 80, the phyIC chip 73, the wires 141 and the lead portions 82*a*, 83*a*, and 86*a* are sealed.

The resin package unit 71A is combined with the insulator block 90 and a resin package unit assembly is prepared in the same manner as mentioned above. The resin package unit assembly is embedded in the shield cover assembly 60 in the same manner as in the resin package unit assembly 70.

Instead of the phyIC chip 73, a passive-type IC chip may be used.

The structure of the present invention in which the leads of the resin package unit are used as contacts is not limited to the connector for balanced transmission in the above-mentioned example but can be applied to a general connector in which a single signal wire is assigned to a single signal. In this case, it is not necessary to construct the contacts in pairs.

The present invention is not limited to the specifically disclosed embodiment, and variations and modifications may be made without departing from the scope of the present invention.

The present application is based on Japanese priority application No. 2006-186887 filed Jul. 6, 2006, the entire contents of which are hereby incorporated herein by reference.

What is claimed is:

1. A connector comprising:

a shield cover assembly having an equalizer function unit therein;

a fit connection unit having contacts arranged at a tip of the shield cover assembly, the fit connection unit being fitted and connected to a destination connector;

a cable extending from a backside of the shield cover assembly; and a resin package unit assembly inside the shield cover assembly, the resin package unit assembly being made of a combination of a resin package unit and an insulator block, wherein the resin package unit includes a resin package portion, an element having an equalizer function inside the resin package portion, a plurality of leads for contact protruding from the resin package portion and forming contacts, and a plurality of leads for electrical wire connection protruding from the resin package portion, the plural leads for electrical wire connection being connected to an electrical wire, the insulator block has a groove portion for accepting the leads for contact, the resin package unit and the insulator block are combined with each other while the leads for contact are fitted into the groove portion, and a portion of the leads for contact fitted into the groove portion in the insulator block forms the fit connection unit, and an electrical wire extending from an end of the cable is connected to the lead for electrical wire connection.

2. The connector according to claim 1, wherein the plural leads for contact and the plural leads for electrical wire connection have a collective lead portion, the element has a chip with an equalizer function sealed with resin inside the resin package portion in the resin package unit and a lead for mounting protrudes from the resin package portion, the lead for mounting of the element is soldered with an end of the lead portion, and an entire portion of the element and the lead portion are sealed in the resin package portion.

3. The connector according to claim 1, wherein the plural leads for contact and the plural leads for electrical wire connection have a collective lead portion, the resin package unit has an island, the element is made of a chip and fixed on the island, and the chip is connected to an end of the lead portion via a bonded wire, and an entire portion of the chip, an entire portion of the island, and the lead portion are sealed in the resin package portion.

4. The connector according to claim 1, wherein the leads for contact are made of two leads for contact forming pairs.

5. The connector according to claim 2, wherein the leads for contact are made of two leads for contact forming pairs.

6. The connector according to claim 3, wherein the leads for contact are made of two leads for contact forming pairs.

* * * * *